US009184540B2

(12) United States Patent
Wilinski

(10) Patent No.: US 9,184,540 B2
(45) Date of Patent: Nov. 10, 2015

(54) METAL PART FOR AN ELECTRICAL CONNECTION DEVICE, A METHOD OF PRODUCING SAME AND AN ELECTRICAL TERMINAL EQUIPPED THEREWITH

(75) Inventor: Bernd Wilinski, Lemgo (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 141 days.

(21) Appl. No.: 13/985,717

(22) PCT Filed: Feb. 22, 2012

(86) PCT No.: PCT/EP2012/000761

§ 371 (c)(1),
(2), (4) Date: Aug. 15, 2013

(87) PCT Pub. No.: WO2012/113544

PCT Pub. Date: Aug. 30, 2012

(65) Prior Publication Data

US 2013/0330985 A1 Dec. 12, 2013

(30) Foreign Application Priority Data

Feb. 22, 2011 (DE) ..... 10 2011 012 021

(51) Int. Cl.

| | |
|---|---|
| ***H01R 4/10*** | (2006.01) |
| ***H01R 13/629*** | (2006.01) |
| ***H01R 43/16*** | (2006.01) |
| *H01R 4/48* | (2006.01) |

(52) U.S. Cl.

CPC ..... *H01R 13/629* (2013.01); *H01R 43/16* (2013.01); *H01R 4/4836* (2013.01); *Y10T 29/49204* (2015.01)

(58) Field of Classification Search

CPC ... H01R 4/4845; H01R 4/4836; H01R 4/4818
USPC ..... 439/877, 828, 834, 835, 370, 259
See application file for complete search history.

(56) References Cited

U.S. PATENT DOCUMENTS 5,993,270 A * 11/1999 Geske et al. ..... 439/835
2011/0312208 A1* 12/2011 Hoppmann ..... 439/370

FOREIGN PATENT DOCUMENTS

DE 20 2005 005 369 U1 4/2006
DE 20 2007 012 429 U1 12/2007
DE 10 2008 039 232 A1 2/2010

* cited by examiner

*Primary Examiner* — Hae Moon Hyeon
(74) *Attorney, Agent, or Firm* — Roberts Mlotkowski Safran & Cole, PC

(57) ABSTRACT

A metal part for an electric connecting device for connecting at least one stripped conductor end has a base limb, a contact limb that is substantially perpendicular relative to said base limb, and at least one lateral wall. The contact limb together with a clamping limb of a clamping spring forms a spring clamp terminal for an electric conductor to be connected. The metal part requires only a small amount of material in that the contact limb is bent away from the base limb, and the lateral wall is bent away from the contact limb, wherein the bending edge between the contact limb and the base limb runs perpendicular relative to the longitudinal extension of the contact limb and the base limb, while the bending edge between the contact limb and the lateral wall runs parallel relative to the longitudinal extension of the contact limb.

13 Claims, 5 Drawing Sheets

METAL PART FOR AN ELECTRICAL CONNECTION DEVICE, A METHOD OF PRODUCING SAME AND AN ELECTRICAL TERMINAL EQUIPPED THEREWITH

BACKGROUND OF THE INVENTION

1. Field of the Invention

The invention relates to a metal part for an electrical connecting device for connecting the stripped end of a conductor, with a base leg, a contact leg which is located essentially perpendicular thereto, and with at least one side wall, the contact leg together with a clamping leg of a clamping spring forming a spring force clamp terminal to an electrical conductor which is to be connected. Moreover the invention relates to a method for producing this metal part, and a connecting device and an electrical terminal for connection of a stripped end of a conductor, with a clamping spring which acts as a compression spring on the end of the conductor and which has one clamping leg and one seating leg, and with one metal part.

2. Description of Related Art

Electrical terminals are known in a host of embodiments. The terminals can be made for connection of an electrical conductor to a circuit board as a so-called printed terminal or for connection to another conductor as a terminal block. Clamping springs are both loop-shaped clamping springs, so-called tension spring terminals, and also U-shaped or V-shaped clamping springs into which rigid conductors or conductors which are provided with a wire end ferrule can be inserted directly, i.e., without the clamping site having to be opened beforehand with a tool. In the known loop-shaped tension springs, according to their name, the conductor which is to be connected is pulled by the clamping leg against a busbar. In contrast, for U-shaped or V-shaped clamping springs the conductor which is to be connected is pressed against the busbar or a region of the metal part by the clamping leg of the clamping spring which acts as a compression spring.

Electrical terminals with a clamping spring which acts as a compression spring in addition to a housing which generally are made of plastic have at least one connecting device which is held and located within the housing and which consists of a clamping spring and a metal part. The U-shaped or V-shaped clamping spring has one clamping leg and one seating leg, the clamping leg together with one region of the metal part forming a spring force clamp terminal for the stripped electrical conductor which is to be connected and which has been inserted into the electrical terminal.

The metal part is used, first of all, for transmission of a current between the contact site with the electrical conductor and a second contact site which can be a contact site to a circuit board or also a contact site to a second conductor. In the latter case the metal part is thus used to transmit a current from a first electrical conductor which is connected to a first spring force clamp terminal to a second conductor which is connected to a second spring force clamp terminal. But in addition, the metal part is generally also used to hold the clamping spring and especially for lateral guidance of the inserted conductor, for which the metal part in addition to the base leg and the contact leg has at least one side wall which runs essentially perpendicular thereto and which prevents the stripped end of the conductor from being forced out of the region of the clamping site.

An electrical terminal with the initially described metal part is known, for example, from German Patent Application DE 10 2008 039 232 A1. The metal part has a relatively large-area side wall from which one contact leg, one base leg and one seating leg are bent away to three different sides of the side wall. The contact leg together with the clamping leg of the clamping spring forms the spring force clamp terminal for an electrical conductor which is to be connected. The seating leg of the clamping spring adjoins the seating leg of the metal part opposite the contact leg, as a result of which the clamping spring is held by the metal part. Additional holding and fixing of the clamping spring take place by means of a pin which has been formed in the housing. The current is transmitted from the conductor which has been inserted at the contact site to a second contact site via the base leg which runs perpendicular to the contact leg.

German Utility Model DE 20 2005 005 369 U1, likewise, discloses an electrical terminal which has at least one connecting device which formed of a clamping spring and a metal part. The metal part is made as a channel-like, U-shaped trough with a base leg and two longitudinal legs, one end of the longitudinal leg being bent away such that the end runs perpendicular to the two longitudinal legs and to the base leg. The end which has been bent away in this way forms the contact leg which together with the clamping leg of the clamping spring forms the spring force clamp terminal for the electrical conductor device which is to be connected.

A similar metal part is also known from German Utility Model DE 20 2007 012 429 U1. Here, the metal part also has a base leg and two longitudinal legs which are bent perpendicularly away from it, also here the contact leg being formed by the bent end of one longitudinal leg. Moreover in this metal part a reinforced bottom section is provided by a fold section being folded from one of the two longitudinal legs and being located opposite on the bottom of the base leg.

It is common to the known metal parts that they are punched out of a flat metal strip and then are brought into their finished form by bending down individual sections. Here, the disadvantage is that they require increased material use which is not determined solely by the required current carrying capacity.

SUMMARY OF THE INVENTION

Therefore, the object of this invention is to make available the initially described metal part for an electrical connecting device which requires as little material use as possible with good functionality.

This object is achieved in the initially described metal part in accordance with the invention in that the contact leg is bent away from the base leg and the side wall is bent away from the contact leg, the bending edge between the contact leg and the base leg running perpendicular to the longitudinal extension of the contact leg and of the base leg, while the bending edge between the contact leg and the side wall runs parallel to the longitudinal extension of the contact leg and of the side wall.

In contrast to the metal parts known from the prior art, in the metal part in accordance with the invention, the contact leg is not bent away from the side wall, the side wall itself being bent away from the base leg, but is bent away directly from the base leg. Moreover, the side wall is not bent away from the base leg, but from the contact leg. Here, it has been recognized in accordance with the invention that the material use for producing the metal part can be greatly reduced by the legs which determine the total height of the finished metal part being arranged such that the bending edges around which they are bent run parallel to the transport direction.

In the metal parts for an electrical connecting device of a terminal, the leg which determines the total height of the metal part is the contact leg. While in the metal parts according to the prior art in the initial state, i.e., before bending down, the longitudinal extension of the contact leg runs parallel to the transport direction when the metal part is punched out and bent down, in the metal part in accordance with the invention, not only the base leg, but also the contact leg extend perpendicular to the transport direction. This increases, for example, the dimension (length) of the metal strip perpendicular to the transport direction, at the same time however, the dimension (width) of the metal strip can be greatly reduced in the transport direction, as a result of which altogether a distinct reduction of the material use per metal part arises.

The side wall which is bent away laterally from the contact leg is used as a boundary for the end of the conductor which is to be connected, thus the end of the conductor is not forced laterally out of the contact site by the clamping leg of the clamping spring. Without formation of a side wall, this risk would exist especially for flexible conductors which have a plurality of individual flexible leads, and of which at least individual flexible leads can be forced past the contact leg. Preferably, the side wall has a longitudinal extension which is somewhat smaller than the longitudinal extension of the contact leg, the side wall being connected to the contact leg such that the upper end of the contact leg, which end is remote from the base leg, and the upper end of the side wall lie roughly at the same height.

According to one preferred configuration, there is a second side wall which is bent away from the base leg, the second side wall being located on the same side of the metal part as the first side wall. The bending edge between the second side wall and the base leg runs parallel to the longitudinal extension of the second side wall and to the longitudinal extension of the base leg. A corresponding dimensioning and configuration of the first side wall and of the second side wall can produce a coherent side surface which together forms a boundary for the connected end of the conductor. Preferably, the end regions of the two side walls, which regions are facing one another, are made such that the two side walls in the finished state of the metal part are positively connected to one another. The anchoring of the two side walls to one another which is achieved in this way advantageously also yields a stabilization of the contact leg which is bent away from the base leg so that there is no risk that the contact leg will be forced out of its given position by the force of the clamping spring.

According to another advantageous configuration, the end of the second side wall facing away from the first side wall is bent away from the second side wall such that the end is opposite the contact leg. The bending edge between the second side wall and the end runs perpendicular to the longitudinal extension of the second side wall. Preferably the bent end has a length which corresponds roughly to the width of the contact leg and of the base leg.

In the above described preferred configuration of the metal part in accordance with the invention with two side walls which together form a closed side surface, not only are a connected conductor end reliably prevented from being forced out laterally and a high stability of the contact leg achieved, but the bent end of the second side wall moreover also makes available a seating surface for the seating leg of the clamping spring so that the metal part is also used for attaching or holding the clamping spring.

The metal part in accordance with the invention can be produced simply from a metal strip as a punched and bent part, generally a plurality of metal parts being punched out and bent over from a larger metal piece. Up to completion of the individual metal parts, they are generally connected among one another via transport pieces which support transport of the metal strip or of the metal piece in the transport direction so that the individual metal parts can be punched free and bent over in several successive process steps, while the metal piece is moved in the transport direction.

One preferred method for producing a metal part in accordance with the invention from a flat metal strip is characterized here in that, first of all, in a first step, the contour of the metal part is punched free. In a second step, then, the first side wall is bent around a bending edge between the side wall and the contact leg, the bending edge running parallel to the longitudinal extension of the contact leg and perpendicular to the transport direction of the metal strip. In another step, the contact leg is bent around a bending edge between the contact leg and the base leg, the bending edge running perpendicular to the longitudinal extension of the contact leg and of the base leg and parallel to the transport direction of the metal strip.

In the method in accordance with the invention for producing a metal part from a flat metal strip, the longitudinal extension of the metal strip which is required for a metal part is determined essentially by the length of the base leg and the length of the adjoining contact leg, while the width of the metal strip is essentially determined by the width of the contact leg and of the first side wall or the generally equivalent width of the base leg and of the second side wall. The transport direction in the production of the metal part is perpendicular to the aforementioned longitudinal extension of the metal strip.

According to one preferred configuration of the method in accordance with the invention, moreover, in another step, on the side of the metal strip on which the first side wall is located, a second side wall is bent around a bending edge between the second side wall and the base leg, the bending edge running parallel to the longitudinal extension of the second side wall and perpendicular to the transport direction of the metal strip.

Depending on the specific configuration of the contour of the facing end regions of the two side walls, the second side wall can be bent over before or after the first side wall or the contact leg is bent over. But here it is generally advantageous if, first of all, the contact leg with the already bent-down first side wall, and only then, the second side wall is bent down since here a simpler positive connection of the two side walls to one another can be achieved.

According to another preferred configuration of the method in accordance with the invention, the end of the second side wall facing away from the first side wall is bent down from the second side wall until the end of the second side wall is opposite the contact leg. The bending edge between the second side wall and its end around which the end of the second side wall is bent runs perpendicular to the longitudinal extension of the second side wall and parallel to the transport direction of the metal strip. Preferably, the end of the second side wall is bent down before the second side wall itself is bent down.

In addition to the metal part in accordance with the invention and the method for producing the metal part, the invention also relates to a connecting device for connecting the stripped end of a conductor and also to an electrical terminal. The connecting device comprises the metal part in accordance with the invention and a clamping spring which acts as a compression spring on the end of the conductor and which has a clamping leg and a seating leg, the contact leg of the metal part together with the clamping leg of the clamping spring forming a spring force clamp terminal for an electrical conductor which is to be connected.

Besides the connecting device, the electrical terminal has a housing in which the connecting device, i.e., the metal part and the clamping spring, are located. Moreover, at least one conductor insertion opening is made in the housing for inserting a conductor which is to be connected and at least one actuation opening is made. The actuation opening is used to guide an actuating tool in order to press with it against the clamping leg of the clamping spring such that the clamping site is opened and a connected conductor can be pulled out of the terminal again. The actuating tool can be, for example, the tip of a screwdriver.

According to a preferred configuration of the electrical terminal, the clamping site is opened, not using a separate actuating tool, but using an actuating pusher which is movably located in the housing. The actuating pusher is located in the actuating opening such that it can be moved out of a first position in which the spring force clamp terminal is closed into a second position in which the actuating pusher with its end facing the clamping leg deflects the clamping leg against the spring force of the clamping spring so that the spring force clamp terminal is opened. In the housing, a shoulder is made and on the actuating pusher at least one projection is made, the actuating pusher being movable into a position in which the projection and the shoulder are locked to one another such that the actuating pusher is kept in its second position.

If the actuating pusher is in its second position so that the spring force clamp terminal is opened, not only can a connected conductor device be pulled out of the electrical terminal, but a flexible conductor can also be inserted into the terminal. With respect to other possible configurations of the actuating pusher, reference is made to German Patent Application DE 10 2008 039 232 A1.

According to the last advantageous configuration of the electrical terminal which will still be explained briefly here, the electrical terminal has not only a connecting device, but at least two connecting devices. The electrical terminal is thus used to connect at least two stripped conductor ends. For this purpose, there are two clamping springs and functionally at least two metal parts in the housing of the terminal, the metal parts to be produced from a single flat metal strip. If the terminal has two connecting devices, the two base legs of the two metal parts are integrally connected to one another. The base legs thus form the middle region of the metal strip while the two contact legs are located on the two opposite ends of the metal strip.

In particular, are a host of possibilities for embodying and developing the metal part in accordance with the invention and the connecting device or the electrical terminal. In this regard reference is made to the following description of preferred exemplary embodiments in conjunction with the accompanying drawings.

DETAILED DESCRIPTION OF THE INVENTION

Figure 1:
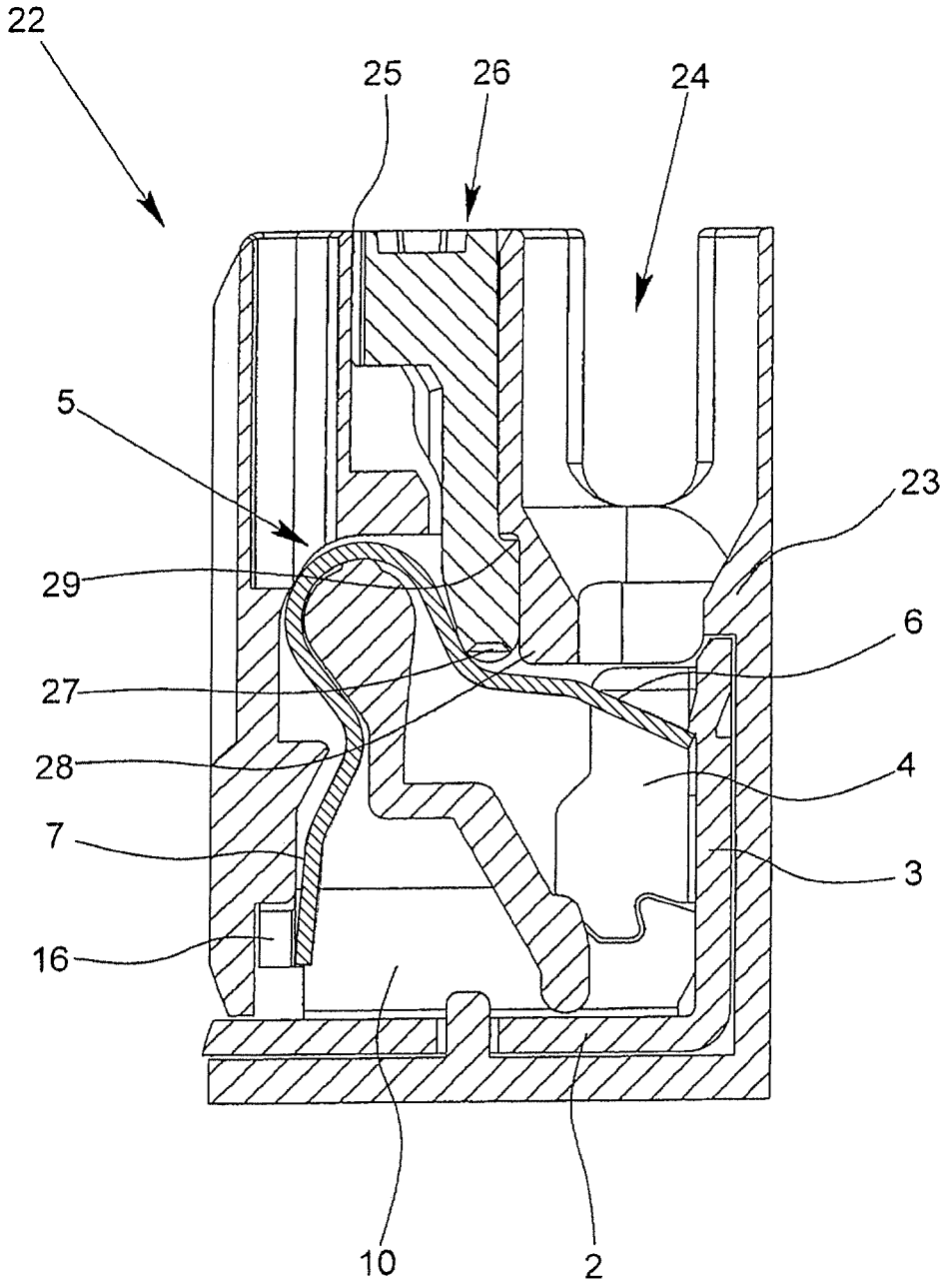
FIG. 1 is a longitudinal sectional view of an embodiment of an electrical terminal in accordance with the invention.

The figures show a metal part 1 in accordance with the invention and individual method steps for its production. The metal part 1 has at least one base leg 2 and at least one contact leg 3 as well as at least one first side wall 4. The metal part 1, together with a clamping spring 5, (shown only in FIG. 1), forms an electrical connecting device for connecting at least one stripped conductor end, the contact leg 3 of the metal part 1 together with the clamping leg 6 of the clamping spring 5 forming a spring force clamp terminal for the conductor which is to be connected. The clamping spring 5, which acts as a compression spring on the end of the conductor, in addition to the clamping leg 6, has another seating leg 7 so that the clamping spring 5 is formed altogether roughly in a V-shape.

Figure 2:
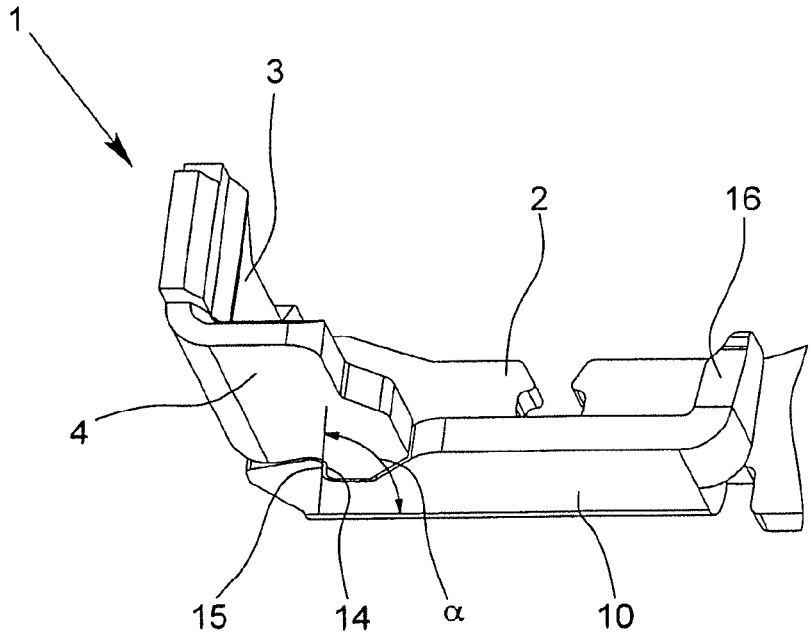
FIG. 2 is a perspective of a metal part in accordance with the invention.
Figure 4A:
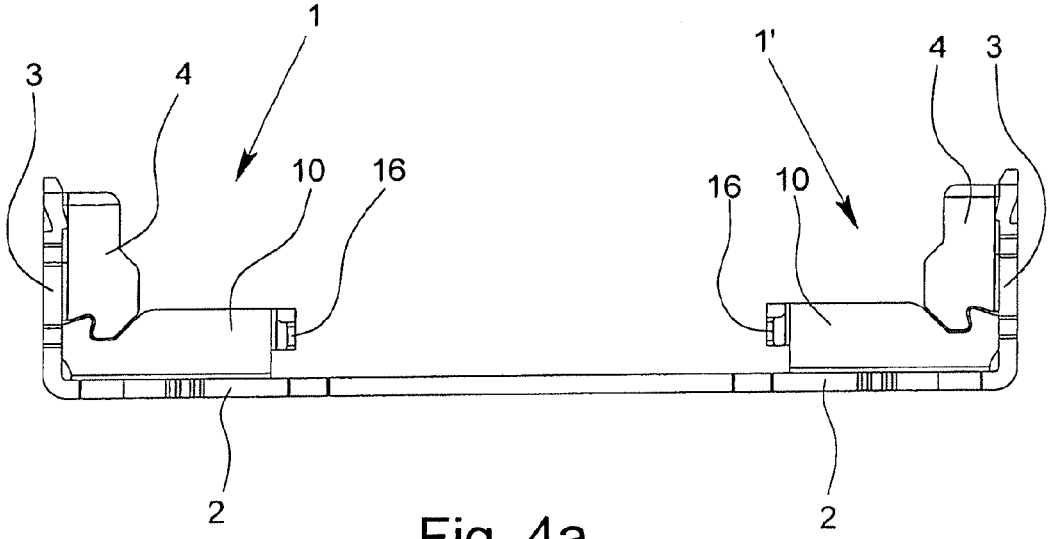
FIGS. 4*a* & 4*b* show a metal part for connection of two stripped conductor ends in side and plan views, respectively.
Figure 4B:
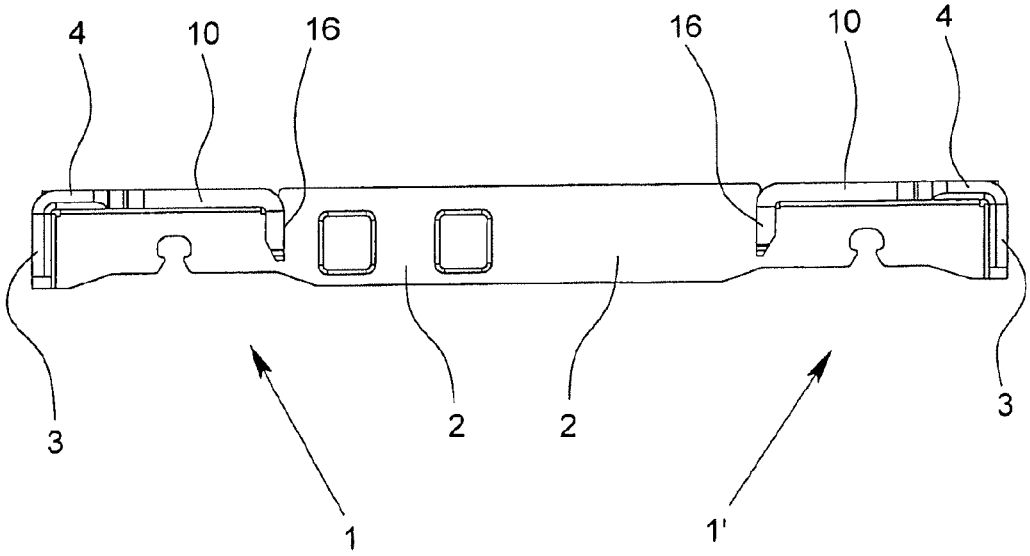

The metal part 1 which is shown in FIG. 2, together with the clamping spring 5, forms a connecting device for a stripped conductor, for which the end of the conductor is pressed by the clamping leg 6 against the contact leg 3. Then, current is transmitted via the metal part 1 from the connected electrical conductor to a second contact site which can be, for example, a contact site to a circuit board. Moreover, the second contact site can also be the clamping site for connection of a second conductor in a second connecting device. Such a connecting device is then used for termination and electrical connection of two stripped conductor ends, the connecting devices having two clamping springs 5 and functionally two metal parts 1, 1', the two metal parts 1, 1', however, being connected integrally to one another, as is shown in FIGS. 4 to 6.

Conversely, FIG. 2 shows a metal part 1 to which only one stripped conductor can be connected by means of a contact spring 5. It is irrelevant to the configuration of the metal part 1 how the base leg 2 continues to run on the side facing away from the contact leg 3, i.e., whether the base leg 2 is connected to the base leg of a second metal part 1' according to FIG. 4, or for example, to a terminal pin for a circuit board.

Figure 3:
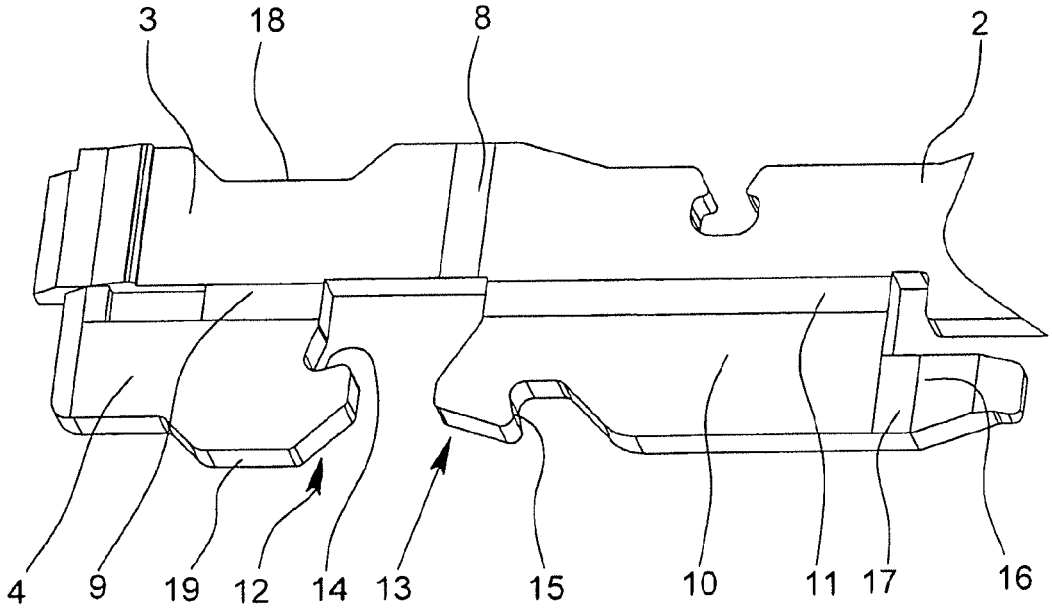
FIG. 3 shows a punched-out metal strip from which the metal part according to FIG. 2 is bent.
Figure 5A:
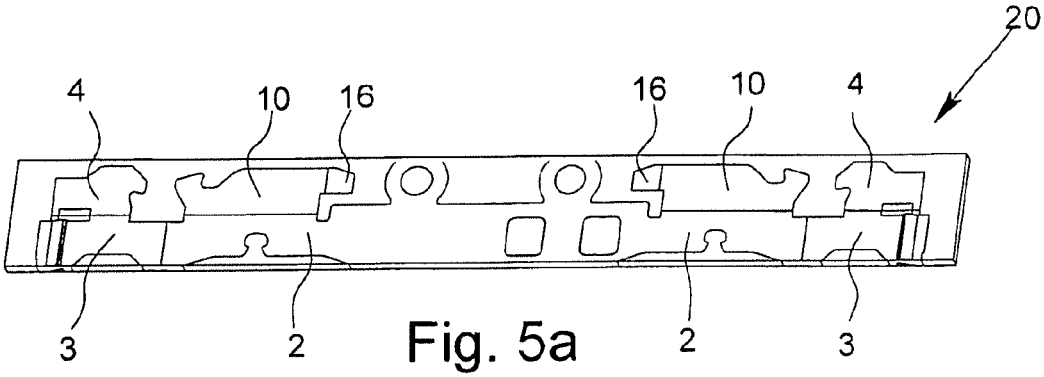
FIG. 5 shows the individual method steps for producing the metal part according to FIGS. 4.
Figure 5B:
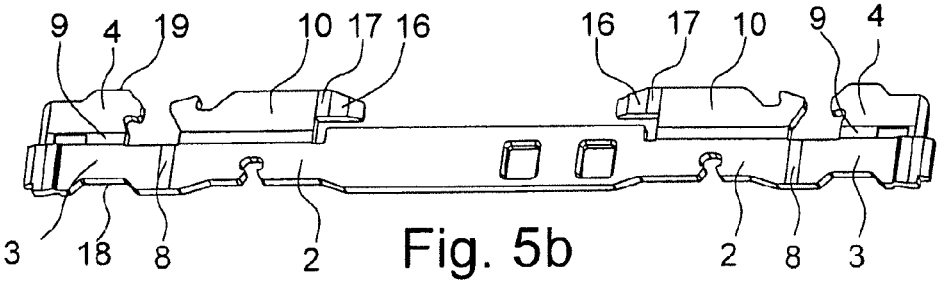
Figure 5C:
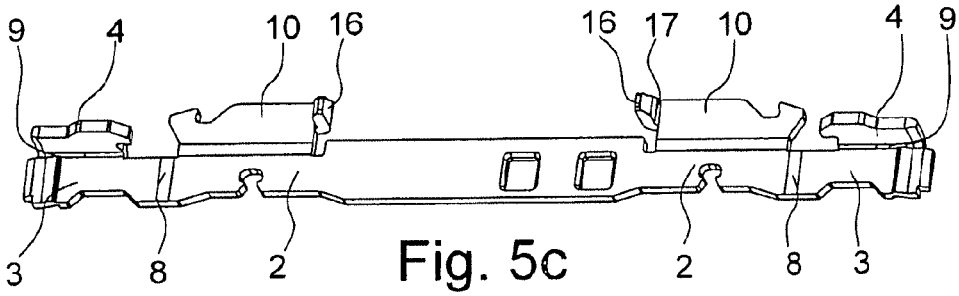
Figure 5D:
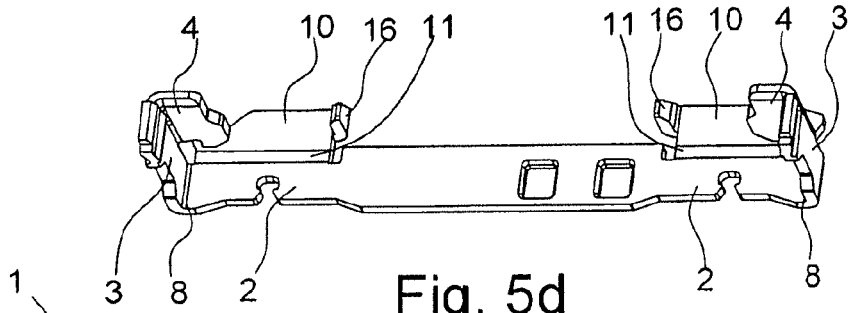
Figure 5E:
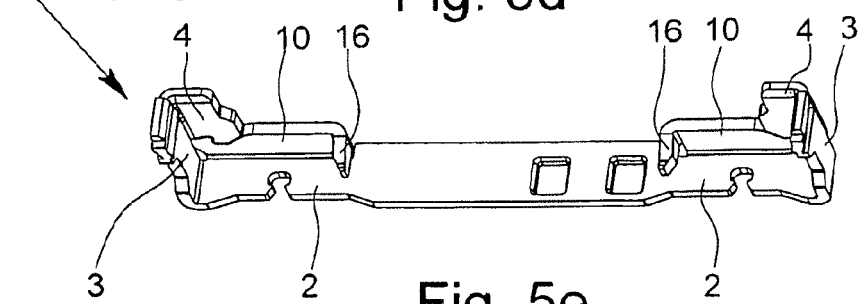
Figure 6:
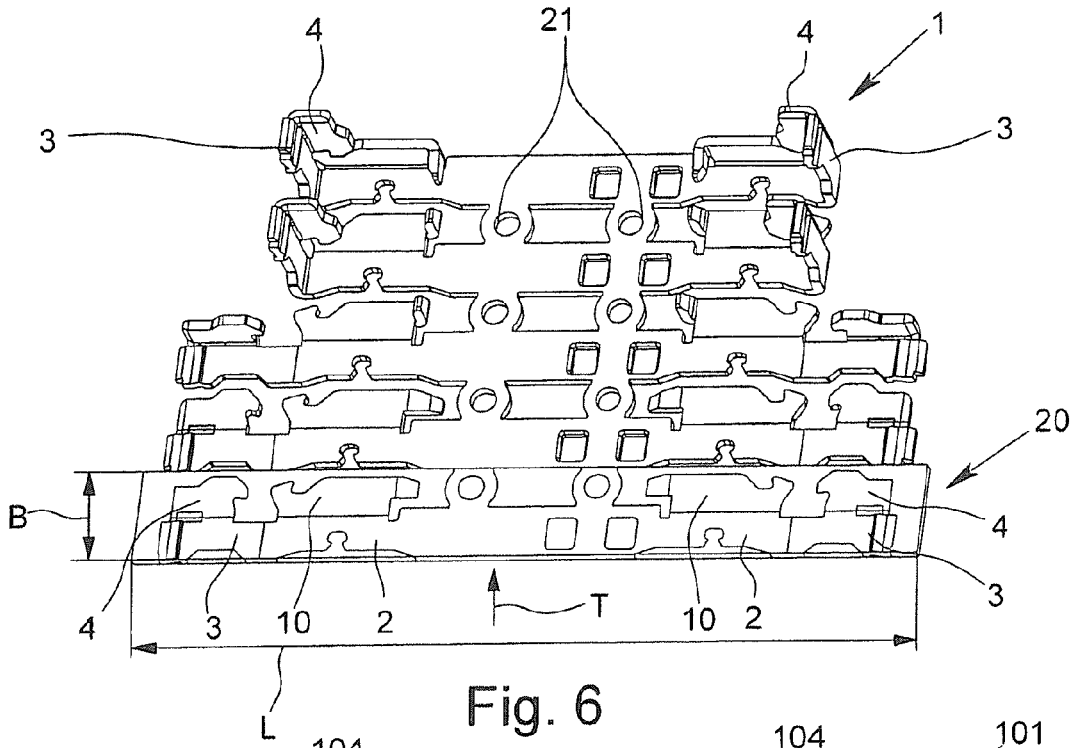
FIG. 6 shows a metal piece with several metal strips in the different method steps according to FIG. 5, in accordance with the invention.

A comparison of FIGS. 2 and 3 and the method steps shown in FIGS. 5 and 6 for producing the metal part 1 show that the contact leg 3 is connected directly via a bending edge 8 to the base leg 2, the bending edge 8 between the contact leg 3 and the base leg 2 extending perpendicular to the longitudinal extension of the contact leg 3 and of the base leg 2. The contact leg 3 directly adjoins an end of the base leg 2, so that the base leg 2 and the contact leg 3 extend in the same direction before being bent down. In contrast, the first side wall 4 is not bent away from the base leg 2, but from the contact leg 3, the bending edge 9 runs between the contact leg 3 and the side wall 4 parallel to the longitudinal extension of the contact leg 3.

In addition to the first side wall 4 which is connected to the contact leg 3 via the bending edge 9, the metal part 1 has another second side wall 10 which is bent away from the base leg 2. The bending edge 11 between the base leg 2 and the second side wall 10 runs in the same manner as the bending edge 9 parallel to the longitudinal extension of the base leg 2 and of the contact leg 3, the two side walls 4, 10 being located on the same side of the metal part 1, i.e., on the same side of the base leg 2 and of the contact leg 3.

The first side wall 4, which is bent laterally away from the contact leg 3, is used as a boundary for the end of the conductor which is to be connected, so that the end of the conductor is not forced laterally out of the contact site by the clamping leg 6 of the clamping spring 5, or forced past the contact leg 3. This risk would exist without the side wall 4, especially for a flexible conductor which consists of a plurality of individual flexible leads so that individual flexible leads could be forced laterally past the contact leg 3 by the clamping leg 6. The second side wall 10 is used, on the one hand, as an additional boundary for the end of the conductor to be connected, but on the other hand, also especially for stabilization of the contact leg 3, the two facing end regions 12, 13 of the two side walls 4, 10 are positively connected to one another in the finished state of the metal part 1. For this purpose, the end regions 12, 13 of the two side walls 4, 10 each have a contour which corresponds to one another, especially there being a respective edge 14, 15 which, in the finished state of the metal part 1, has an acute angle a of between 45° and 90° relative to the base leg 2. This reliably prevents the contact leg 3 from being bent down unwantedly by the spring force of the clamping spring 5 since the two side walls 4, 10 are reliably hooked to one another by their end regions 12, 13 which are made accordingly.

To support the seating leg 7 of the clamping spring 5, the end 16 of the second side wall 10 facing away from the first side wall 4 is bent away from the second side wall 10 such that the end 16 is opposite the contact leg 3. The bending edge 17 runs perpendicular to the longitudinal extension of the second side wall 10 between the second side wall 10 and its end 16.

In order to still further reduce the material use in the production of metal part 1 in accordance with the invention, on the longitudinal side of the contact leg 3 facing away from the first side wall 4, there is an indentation 18 and on the longitudinal side of the first side wall 4 facing away from the contact leg 3 there is a projection 19, the contour of the indentation 18 and the contour of the projection 19 being matched to one another. This can further reduce the distance between the individual metal parts 1 in the production of several metal parts 1.

The method in accordance with the invention for producing a metal part 1 will be explained in detail below using FIG. 5 which shows five method steps in succession.

The starting point for production of a metal part 1 is a flat metal strip 20, in industrial production generally the individual metal parts 1 being punched free and bent over, not from individual narrow metal strips 20, but from a larger metal section with a plurality of metal strips 20, as is apparent from FIG. 6. After punching free, the metal part 1, as is shown in FIG. 5*b*, the first side wall 4 is bent around the bending edge 9 and the end 16 of the second side wall 10 is bent around the bending edge 17 (compare FIG. 5*c*), the bending generally taking place by 90°. In the next method step, according to FIG. 5*d*, the contact leg 3 is bent around the bending edge 8 so that the contact leg 3 and with it also the first side wall 4 extend perpendicular to the longitudinal extension of the base leg 2. Finally, the second side wall 10 is bent around the bending edge 11, based on the matched contour of the end regions 12, 13 of the two side walls 4, 10 the two side walls 4, 10, then being connected positively to one another so that the contact leg 3 is reliably prevented from being bent down, in the figures to the outside, by the clamping spring 5.

Even if FIGS. 5*a-e* show a metal part 1 for connection of two stripped conductor ends, one skilled in the art can easily recognize that not only a metal part 1 for connection of only one conductor as shown in FIGS. 2 and 3, but also a metal part for connection of more than two conductors can be easily produced from a corresponding metal strip 20, and the above described method steps fundamentally can also be carried out.

Figure 7:
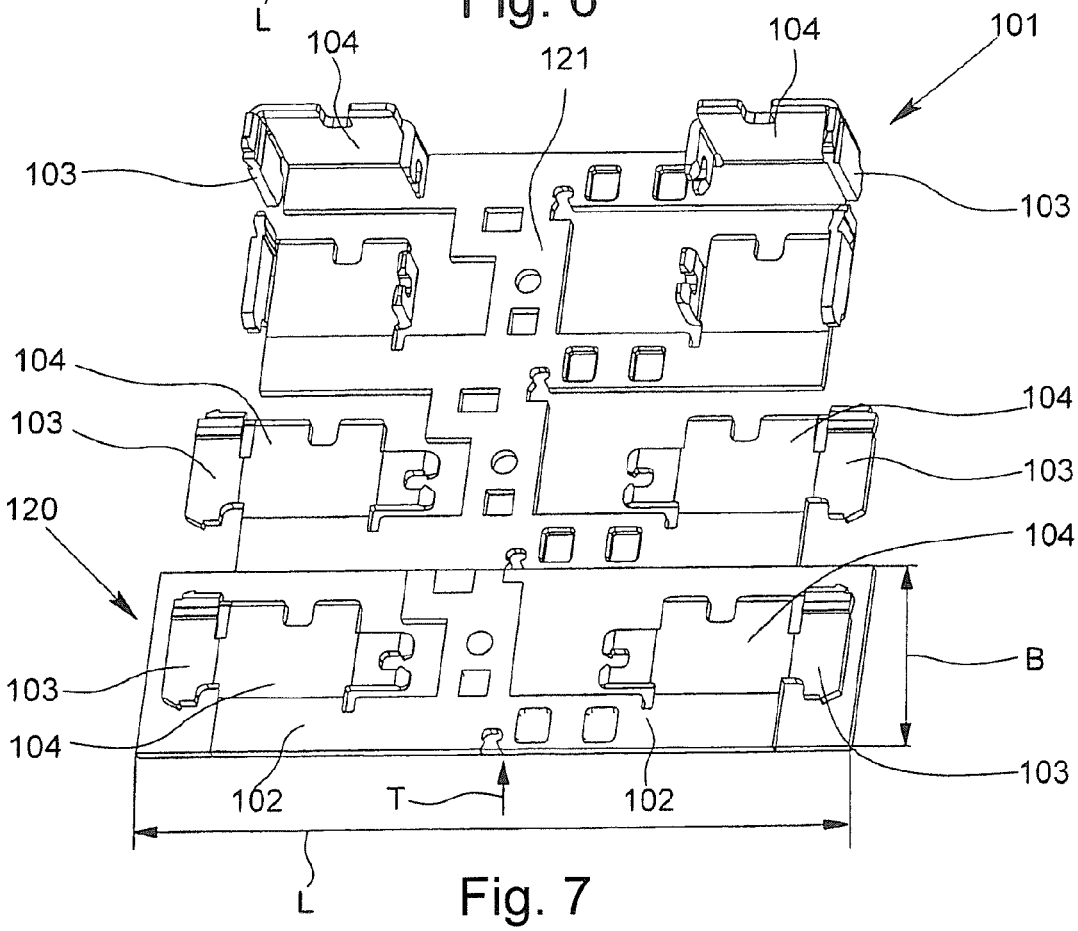
Fig. 7 (Prior Art)
FIG. 7 shows a metal piece with several metal strips in the different method steps for producing a metal part according to the prior art.

That much less material need be used in the production of the metal part 1 in accordance with the invention is also apparent from a comparison of FIGS. 6 and 7. In this regard, FIG. 6 shows the production of several metal parts 1 in accordance with the invention from one piece 20 of metal, while FIG. 7 shows the production of known metal parts 101 from one piece of metal.

A metal strip 20 for a metal part 1 in accordance with the invention as compared to a metal strip 120 for producing a metal part 101 known from the prior art has a somewhat greater length L, but for this reason, a much smaller width B so that the area of the metal strip 20 is only roughly 65% of the area of the metal strip 120 without the current carrying capacity of the metal part 1 being reduced as compared to metal part 101. This distinct saving of material arises especially from the fact that, for the metal part 1 in accordance with the invention, the contact leg 3 is bent directly away from the base leg 2, while in the metal part 101 from the prior art the contact leg 103 is bent away from the side wall 104. In the metal part 101 according to the prior art, the contact leg 103 which determines the total height of the metal part 101 is aligned parallel to the transport direction T of the metal strip 120, while in the metal part 1 in accordance with the invention the contact leg 3 runs perpendicular to the transport direction T. In the metal part 1 in accordance with the invention, the longitudinal extension both of the base leg 2 and also of the contact leg 3 as well as the longitudinal extension of the two side walls 4, 10 are aligned perpendicular to the transport direction T, as a result of which the scrap area of the metal strip 20 which is not used for the metal part 1 is distinctly reduced.

If not only a single metal strip 20 is punched out and bent over, but as shown in FIG. 6 several metal parts 1 are produced from a larger piece of metal, the individual metal parts 1 after punching free their contour are first connected to one another via corresponding transport pieces 21 which are used to transport the metal strip 20 in the transport direction T.

The electrical terminal 22 as whole (which is shown only in FIG. 1) has a housing 23 in which there is also a clamping spring 5 in addition to the metal part 1 described above. In the housing 23, moreover, a conductor insertion opening 24 for insertion of the conductor to be connected and an actuating opening 25 are formed. Within the actuating opening 25, an actuating pusher 26 is movably arranged, the actuating pusher 26 being movable out of a first position which is shown in FIG. 1 into a second depressed position. In the first position, the end 27 of the actuating pusher 26 facing the clamping leg 6 does not press against the clamping leg 6 so that the spring force clamp terminal is closed. In the second depressed position of the actuating pusher 26, conversely, the clamping leg 6 is deflected by the actuating pusher 26 against the spring force of the clamping spring 5 so far that the spring force clamp terminal is opened and a connected conductor can be pulled out of the clamping site.

So that the actuating pusher 26 can lock in the second position, a shoulder 28 is formed in the housing 23 and a projection 29 is formed on the actuating pusher 26, the projection 29 in the second position of the actuating pusher 26 being pressed by the spring force of the clamping spring 5 against the shoulder 28 in the housing 23. In order to release the actuating pusher 26 from the second position, the tip of a screwdriver can be inserted into a depression made in the head of the actuating pusher 26, and then, the screwdriver can be moved perpendicular to the longitudinal extension of the actuating pusher 26. In this way, the locking between the projection 29 and the shoulder 28 is released.

The invention claimed is:

1. A metal part for an electrical connecting device for connecting a stripped end of an electrical conductor, comprising:

a base leg, a contact leg which is located essentially perpendicular to the base leg, and with at least a first side wall, wherein the contact leg is constructed to act together with a clamping leg of a clamping spring to form a spring force clamp terminal to which the electrical conductor is connectable, wherein the contact leg is bent away from the base leg and the first side wall is bent away from the contact leg, wherein a bending edge between the contact leg and the base leg runs perpendicular to a longitudinal extension of the contact leg and of the base leg, wherein a bending edge between the contact leg and the first side wall runs parallel to the longitudinal extension of the contact leg and further comprising a second side wall which is bent away from the base leg, wherein a bending edge between the second side wall and the base leg runs parallel to a longitudinal extension of the second side wall and of the base leg, and wherein the first and second side walls are located on the same side of the metal part.

2. The metal part as claimed in claim 1, wherein facing end regions of the first and second side walls are are positively connected to one another in a finished state of the metal part.

3. The metal part as claimed in claim 2, wherein the facing end regions of the first and second side walls each have an edge which runs at an acute angle $\alpha$ to the base leg.

4. The metal part as claimed in claim 1, wherein an end of the second side wall facing away from the first side wall is bent away from the second side wall, the bending edge between the second side wall and the end running perpendicular to the longitudinal extension of the second side wall so that the end is opposite the contact leg.

5. The metal part as claimed in claim 1, wherein on a longitudinal side of the contact leg facing away from the first side wall there is an indentation and on a longitudinal side of the first side wall facing away from the contact leg there is a projection, the contour of the indentation and the contour of the projection having configurations that are matched to one another.

6. A method for producing a metal part for an electrical connecting device from a flat metal strip, the metal part having a base leg, a contact leg and at least one side wall, comprising the following steps:

punching free a contour of the metal part from the metal strip, bending a first side wall around a bending edge between the first side wall and the contact leg, the bending edge running parallel to a longitudinal extension of the contact leg and perpendicular to a transport direction of the metal strip, bending the contact leg around a bending edge which runs perpendicular to the longitudinal extension of the contact leg and a longitudinal extension of the base leg and parallel to the transport direction of the metal strip, and bending a second side wall around a bending edge between the second side wall and the base leg on the side of the metal part on which the first side wall is located, the bending edge around which the second side wall is bent running parallel to a longitudinal extension of the second side wall and perpendicular to the transport direction of the metal strip .

7. The method for producing a metal part as claimed in claim 6, wherein, before the second side wall is bent, an end of the second side wall facing away from the first side wall is bent away from the second side wall around a bending edge until the end is opposite the contact leg, the bending edge between the second side wall and the end running perpendicular to the longitudinal extension of the second side wall and parallel to the transport direction of the metal strip .

8. A connecting device for connection of a stripped end of an electrical conductor comprising:

a clamping spring which is constructed so as to act as a compression spring on the end of the electrical conductor, the clamping spring having a clamping leg and a seating leg, and a metal part having a base leg, at least a first side wall, a second side wall and a contact leg, the contact leg together with the clamping leg forming a spring force clamp terminal for the electrical conductor which is to be connected, wherein the contact leg is bent away from the base leg and the first side wall is bent away from the contact leg, wherein a bending edge between the contact leg and the base leg runs perpendicular to a longitudinal extension of the contact leg and of the base leg, and wherein a bending edge between the contact leg and the first side wall runs parallel to the longitudinal extension of the contact leg wherein the second side wall is bent away from the base leg, wherein a bending edge between the second side wall and the base leg runs parallel to a longitudinal extension of the second side wall and of the base leg, and wherein the first and second side walls are locate on the same side of the metal part.

9. An electrical terminal, comprising:

a housing, at least one conductor insertion opening for inserting an electical conductor which is to be connected, and at least one actuation opening for inserting of a tool, at least one clamping spring which is constructed to act as a compression spring on the end of the conductor, which has a clamping leg and a seating leg, the clamping leg being displaceable by the tool inserted in said at least one actuation opening, and at least one metal part having a base leg, at least a first side wall, a second side wall and a contact leg, the contact leg together with the clamping leg forming a spring force clamp terminal for the electrical conductor which is to be connected, wherein the contact leg is bent away from the base leg and the first side wall is bent away from the contact leg, wherein a bending edge between the contact leg and the base leg runs perpendicular to a longitudinal extension of the contact leg and of the base leg, wherein a bending edge between the contact leg and the first side wall runs parallel to the longitudinal extension of the contact leg, wherein the second side wall is bent away from the base leg, wherein a bending edge between the second side wall and the base leg runs parallel to a longitudinal extension of the second side wall and of the base leg, and wherein the first and second side walls are locate on the same side of the metal part.

10. The electrical terminal as claimed in claim 9, wherein an actuating pusher is located in the actuating opening such that the actuating pusher can be moved out of a first position in which the spring force clamp terminal is closed into a second position in which a first end of the actuating pusher deflects the clamping leg against the spring force of the clamping spring so that the spring force clamp terminal is opened, a shoulder being provided in the housing and at least one projection being provided on the actuating pusher, the actuating pusher being movable into a position in which the projection and the shoulder are locked to one another such that the actuating pusher is kept in the second position thereof.

11. The electrical terminal as claimed in claim 10, for connection of two stripped conductor ends, wherein said at least one metal part comprises two metal parts, where the base leg of the metal parts are integrally connected to one another and the two metal parts having been produced from a single flat metal strip.

12. The electrical terminal as claimed in claim 9, for connection of two stripped conductor ends, wherein said at least one metal part comprises two metal parts, where the base leg of the metal parts are integrally connected to one another and the two metal parts having been produced from a single flat metal strip.

13. An electrical terminal as claimed in claim 9, further comprising an actuating pusher, said actuating pusher being movable by the tool inserted in said at least one actuation opening for displacing the clamping leg.

* * * * *